US011420312B2

(12) United States Patent
Meredith

(10) Patent No.: US 11,420,312 B2
(45) Date of Patent: Aug. 23, 2022

(54) FASTENER DRIVING TOOL TRIGGER ASSEMBLY

(71) Applicant: Black & Decker Inc., New Britain, CT (US)

(72) Inventor: Daryl S. Meredith, York, PA (US)

(73) Assignee: Black & Decker Inc., New Britain, CT (US)

( * ) Notice: Subject to any disclaimer, the term of this patent is extended or adjusted under 35 U.S.C. 154(b) by 260 days.

(21) Appl. No.: 16/696,422

(22) Filed: Nov. 26, 2019

(65) Prior Publication Data

US 2020/0171638 A1 Jun. 4, 2020

Related U.S. Application Data

(60) Provisional application No. 62/774,622, filed on Dec. 3, 2018.

(51) Int. Cl.

| | |
|---|---|
| ***B25C 1/00*** | (2006.01) |
| ***B25C 1/04*** | (2006.01) |
| *B25C 1/06* | (2006.01) |
| *B25D 16/00* | (2006.01) |

(52) U.S. Cl.

CPC ..... *B25C 1/008* (2013.01); *B25C 1/043* (2013.01); *B25C 1/047* (2013.01); *B25C 1/06* (2013.01); *B25D 16/006* (2013.01); *B25D 2216/0015* (2013.01); *B25D 2250/261* (2013.01)

(58) Field of Classification Search

CPC ..... B25C 1/008; B25C 1/043; B25C 1/047; B25C 1/06; B25D 16/006; B25D 2250/261

See application file for complete search history.

(56) References Cited

U.S. PATENT DOCUMENTS

| | | | | |
|---|---|---|---|---|
| 6,604,664 | B2 | 8/2003 | Robinson | |
| 9,381,633 | B2 | 7/2016 | Moore et al. | |
| 9,486,907 | B2 | 11/2016 | Birk | |
| 9,550,288 | B2 | 1/2017 | Moore et al. | |
| 9,662,776 | B2 | 5/2017 | Puppala et al. | |
| 9,782,880 | B2 | 10/2017 | Moore et al. | |
| 11,052,522 | B2 * | 7/2021 | Ishikawa | B25C 1/043 |
| 2008/0296337 | A1 * | 12/2008 | Yang | B25C 1/008 227/8 |
| 2014/0110450 | A1 * | 4/2014 | Moore | B25C 1/008 227/8 |

(Continued)

*Primary Examiner* — Thanh K Truong
*Assistant Examiner* — David G Shutty
(74) *Attorney, Agent, or Firm* — Harness, Dickey & Pierce, P.L.C.

(57) ABSTRACT

A mechanical timer mechanism can include a driven gear mounted to a rotary damper and a drive gear operably coupled to the driven gear. In bump mode, movement of a trigger to its firing position can initially move the drive gear into its wind-up position. Thereafter, a contact trip can move the drive gear to its wind-up position and an actuator of the trigger to its firing position each time the contact trip is activated, unless the timing mechanism has timed out between firings. In sequential mode, the drive gear can be moved into a timer lock-out position which holds the contact trip in a bypass position in which the contact trip will not engage the actuator of the trigger unless the trigger is moved to its firing position prior to activation of the contact trip.

21 Claims, 8 Drawing Sheets

(56) References Cited

U.S. PATENT DOCUMENTS

| | | | | |
|---|---|---|---|---|
| 2014/0110452 | A1* | 4/2014 | Moore | B25C 1/043 227/8 |
| 2014/0231485 | A1* | 8/2014 | Bauer | B25C 1/008 227/8 |
| 2016/0114470 | A1 | 4/2016 | Weigmann et al. | |
| 2017/0129084 | A1 | 5/2017 | Moore et al. | |
| 2017/0232599 | A1 | 8/2017 | Puppala et al. | |
| 2017/0274511 | A1* | 9/2017 | Huang | B25C 5/06 |
| 2018/0117747 | A1 | 5/2018 | Hahndel | |
| 2018/0117748 | A1* | 5/2018 | Ishikawa | B25C 1/046 |
| 2019/0389045 | A1* | 12/2019 | Ishikawa | B25C 1/043 |
| 2020/0398412 | A1* | 12/2020 | Yasutomi | B25C 1/047 |

* cited by examiner

FASTENER DRIVING TOOL TRIGGER ASSEMBLY

CROSS-REFERENCE TO RELATED APPLICATIONS

This application claims the benefit of U.S. Provisional Application No. 62/774,622, filed on Dec. 3, 2018. The entire disclosure of the above application is incorporated herein by reference.

FIELD

The present disclosure relates to a fastener driving tool that has different modes of operation, such as for example, a sequential mode, and a bump mode, in which the bump mode times out or reverts out of bump mode after a predetermined amount of time.

BACKGROUND

This section provides background information related to the present disclosure which is not necessarily prior art.

A fastener driving tool is a tool with a reciprocating driver that is selectively driven along a driver axis to drive a fastener, such as a nail, staple, brad, etc. into a workpiece. It can be desirable for such a fastener driving tool to have multiple modes of operation. For example, the tool can have a sequential mode of operation in which the tool will fire and drive a single fastener into a workpiece upon sequential engagement of a contact trip against the workpiece, followed by actuation of a trigger into its firing position. The tool can also have a bump mode of operation in which the tool will fire a fastener into a workpiece each time the contact trip engages or is bumped against a workpiece as long as the trigger has previously been moved into, and remains in, its firing position.

In bump mode, the tool can continue to fire a fastener each time the contact trip is bumped against the workpiece until the trigger is released, allowing it to return to its home position. It can be desirable to have the bump mode time out or revert out of bump mode, so that the user is required to release and reengage the trigger before continued bump mode operation for added safety. Although providing an electronic timer mechanism is one possibility, for non-electrically driven, for example, pneumatic, fastener driving tools adding and powering such electrical components can be problematic and costly for a wide range of reasons.

SUMMARY

This section provides a general summary of the disclosure, and is not a comprehensive disclosure of its full scope or all of its features.

In one aspect of the present disclosure, a fastener driving tool trigger assembly can include a rotary damper coupled to a tool housing. The rotary damper can have a damper shaft. A driven gear can be coupled to the damper shaft to transfer rotation of the driven gear to the damper shaft in a first direction. A drive gear can be coupled to the tool housing and can be movable between a timed-out position and a wind-up position and biased toward the timed-out position. The drive gear can be operably coupled to the driven gear to rotate the driven gear in the first direction as the drive gear moves away from the wind-up position toward the timed-out position, and to rotate the driven gear in a second direction opposite the first direction as the drive gear moves away from the timed-out position toward the wind-up position. A trigger can be pivotably coupled to the tool housing and movable between a trigger home position and a trigger firing position. An actuator can be pivotably coupled to the trigger and movable between an actuator home position and an actuator firing position. A wind-up arm can be coupled to the trigger and engageable with the drive gear to move the drive gear from the timed-out position to the wind-up position in response to the trigger moving from the trigger home position to the trigger firing position. A contact trip can be coupled to the housing and movable between a trip home position and a trip firing position. With the drive gear positioned between the timed-out and wind-up positions, the contact trip can be engaged with the drive gear to move the drive gear into the wind-up position as the contact trip moves from the trip home position to the trip firing position. With the trigger positioned in the trigger firing position, the contact trip can be engaged with the actuator to move the actuator into the actuator firing position as the contact trip moves from the trip home position to the trip firing position. With the drive gear positioned in the timed-out position, the contact trip can be engaged with the drive gear with the drive gear in an orientation which prevents the contact trip from rotating the drive gear into the wind-up position and prevents the contact trip from moving into the trip firing position as the contact trip moves away from the trip home position.

In another aspect of the present disclosure, a fastener driving tool trigger assembly can include a rotary damper coupled to a tool housing. The rotary damper can have a damper shaft. A driven gear can be coupled to the damper shaft to transfer rotation of the driven gear to the damper shaft in a first direction. A drive gear can be coupled to the tool housing and can be movable between a timed-out position and a wind-up position and biased toward the timed-out position. The drive gear can be operably coupled to the driven gear to rotate the driven gear in the first direction as the drive gear moves away from the wind-up position toward the timed-out position and to rotate the driven gear in a second direction opposite the first direction as the drive gear moves away from the timed-out position toward the wind-up position. A trigger can be pivotably coupled to the tool housing and movable between a trigger home position and a trigger firing position. An actuator can be pivotably coupled to the trigger and movable between an actuator home position and an actuator firing position. A mode selector can be coupled to the housing and movable between a bump mode position and a sequential mode position. With the mode selector in the sequential mode position, the mode selector can be operably coupled to the drive gear to hold the drive gear in a timer lock-out position. A wind-up arm can be coupled to the trigger. With the mode selector in the bump mode position, the wind-up arm can be engaged with the drive gear to move the drive gear from the timed-out position to the wind-up position in response to the trigger moving from the trigger home position to the trigger firing position. A contact trip can be coupled to the housing and movable between a trip home position and a trip firing position. With the mode selector in the bump mode position and the drive gear positioned between the timed-out and wind-up positions, the contact trip can be engaged with the drive gear to move the drive gear into the wind-up position as the contact trip moves from the trip home position to the trip firing position. With the mode selector in the bump mode position and the trigger positioned in the trigger firing position, the contact trip can be engaged with the actuator to move the actuator into the actuator firing position as the contact trip moves from the trip home position to the trip firing position. With the mode selector in the bump mode position and the drive gear positioned in the timed-out position, the contact trip can be engaged with the drive gear in an orientation which prevents the contact trip from rotating the drive gear into the wind-up position, and prevents the contact trip from moving into the trip firing position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
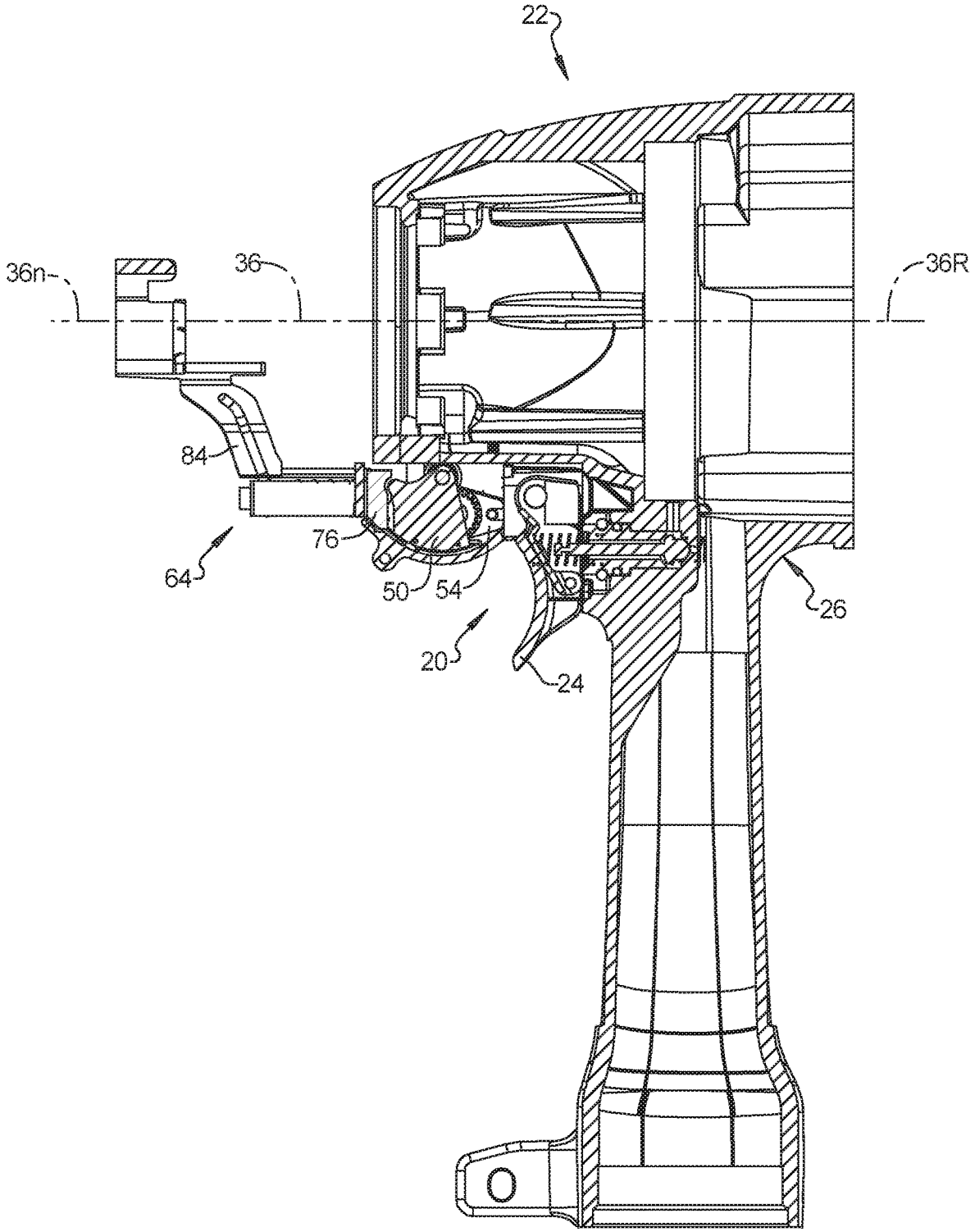
FIG. 1 is a cross-section view of one example of a fastener driving tool trigger assembly in accordance with the present disclosure for a pneumatic fastener driving tool.
Figure 2:
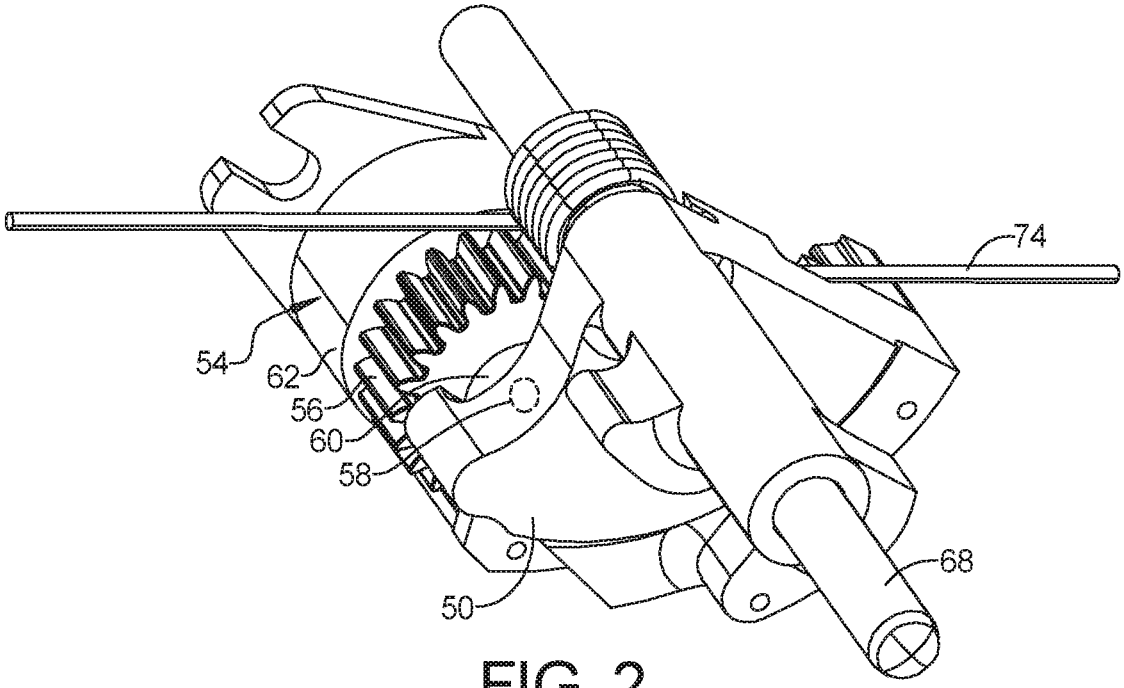
FIG. 2 is a perspective view of a mechanical timer mechanism of the fastener driving tool trigger assembly of FIG. 1.
Figure 3:
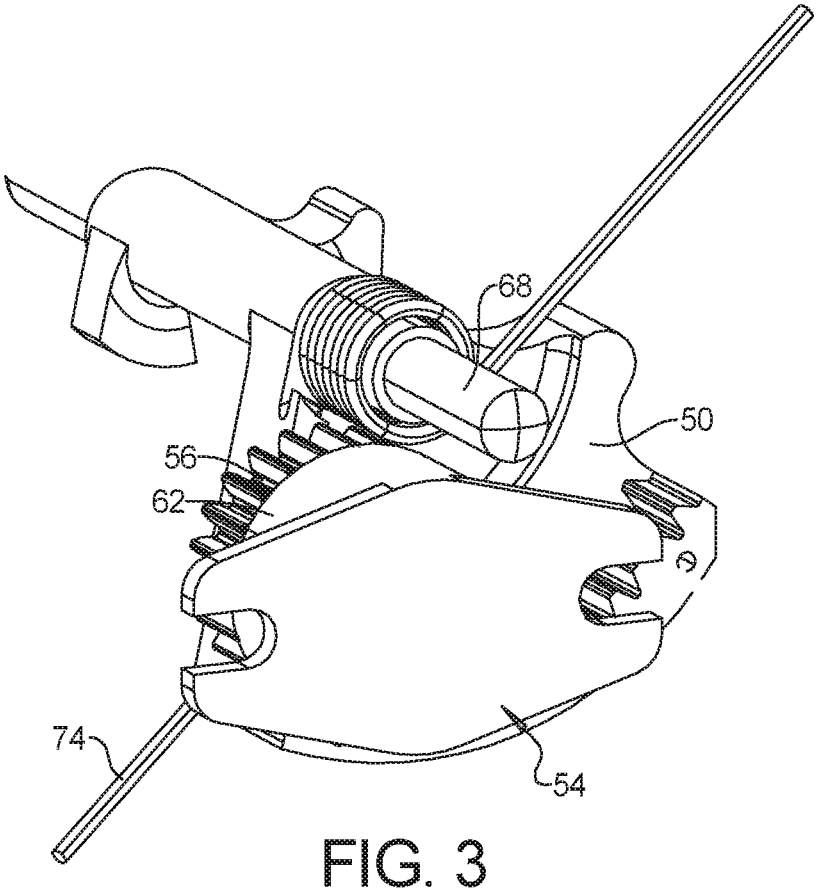
FIG. 3 is another perspective view of a mechanical timer mechanism of the fastener driving tool trigger assembly of FIG. 1.

Example embodiments will now be described more fully with reference to the accompanying drawings.

As shown in FIGS. 1-14, one example of a fastener driving tool automatic reversion trigger assembly 20 in accordance with the present disclosure is provided. The trigger assembly 20 of the fastening tool 22 can include a trigger 24 pivotably coupled to the tool housing 26 about a trigger pivot pin 30. An actuator 28 can be pivotably coupled to and carried by the trigger 24 about an actuator pivot pin 32. As detailed further herein, the trigger assembly 20 can be designed to actuate a trigger valve 34. For example, such actuation of the trigger valve 34 can, directly or indirectly, allow pressurized gas to move a fastener driver (not shown) along a driver axis 36 through a fastener driving cycle of a pneumatic fastener driving tool 22. The trigger assembly 20 can include a contact trip 64 movably coupled to the tool housing to move axially along a driver axis 36.

As in this embodiment, the trigger 24 can have an overall L shape, including a first arm 40 extending downwardly from the trigger pivot pin 30 and from the housing 26 to be manually engaged by a user. A second arm 42 can extend from the trigger pivot pin 30 in a direction toward the forward or nose end of the tool 22 adjacent the nose end **36*n* of the driver axis 36. The trigger 24 can be pivotably coupled to the housing 26 to pivot relative to the housing 26 adjacent an upper or proximal end of the first arm 40 of the trigger 24 or adjacent the juncture between the first arm 40 and second arm 42**.

The actuator 28 can be pivotably coupled to the trigger 24 adjacent the lower or proximal end (with respect to the pivot pin 32) of the actuator 28. The actuator 28 can be pivotably coupled to and carried by the trigger 24 to pivot relative to the trigger 24 adjacent a lower or distal end of the first arm 40 of the trigger 24. When the trigger 24 is pulled, the actuator 28 can be carried by the trigger 24 as the trigger 24 moves. The actuator 28 can be biased relative to the trigger 24 in a counterclockwise direction toward an actuator home position (e.g., FIGS. 4 and 7) by a spring 38 coupled to the housing 26, which can be, for example, a compression spring 38 positioned between the trigger valve 34 and the actuator 28. The same spring 38 can also operate to bias the trigger 24 relative to the housing 26 in a counterclockwise direction toward a trigger home position (e.g., FIG. 4).

A wind-up arm 44 can be pivotably coupled to and carried by the trigger 24 about a wind-up arm pivot pin 48. The wind-up arm 44 can be pivotably coupled to and carried by the trigger 24 adjacent a forward, nose or distal (relative to the pivot pin 30) end of the second arm 42 of the trigger 24. When the trigger 24 is pulled, the wind-up arm 44 can be carried by the trigger 24 as the trigger 24 moves. The wind-up arm 44 can be biased relative to the trigger 24, for example in a counterclockwise direction, toward a wind-up arm home position (e.g., FIG. 4) by a spring 46 coupled to the housing 26, which can be, for example, a torsion spring 46 carried by the trigger 24. The wind-up arm 44 can include a distal end designed to engage a drive gear 50. For example, the wind-up arm 44 can include a hook 52 to rotate the drive gear 50 using a pulling action as detailed herein.

A rotary damper 54 can provide a consistent resistance to rotation of a damper shaft 58. For example, a viscous fluid, such as silicone, can fill a small gap between the damper housing 62 and the damper shaft 58 to provide a consistent frictional resistance to rotation of the damper shaft 58. A one way or "sprag clutch" 60 can be mounted on the shaft 58 of the damper 54. For example, the inner diameter of the one-way clutch 60 can be press-fit onto the shaft 58 of the damper 54. A driven gear 56 can be mounted on the shaft 58 with the one-way clutch 60 between the driven gear 56 and the shaft 58. For example, the driven gear 56 can be press-fit onto the outer diameter of the one-way clutch 60.

As a result of the driven gear 56 being mounted to the damper shaft 58 via the one-way clutch 60, when the driven gear 56 is rotated in a first direction, for example in a counterclockwise direction (as oriented in FIG. 2), the sprag clutch 60 slips or disengages the counterclockwise movement of the driven gear 56 from the damper shaft 58 so that there is no corresponding counterclockwise rotation of the damper shaft 58. In contrast, when the driven gear 56 is rotated in a second, opposite direction, for example the clockwise direction (as oriented in FIG. 2), the sprag clutch 60 transfers the clockwise movement of the driven gear 56 to the damper shaft 58 so that there is a corresponding clockwise rotation of the damper shaft 58. Thus, in the second, opposite direction the rotary damper 54 provides consistent dampening or resistance to rotation of the driven gear 56, but not in the first direction.

The drive gear 50 can be coupled to the driven gear 56. The drive gear 50 can be mounted on an axle or pivot pin 68 and can be biased to rotate in a first direction, for example, in a clockwise direction (as oriented in FIG. 2) about the drive gear pivot pin 68 by a timer spring 74, causing the driven gear 56 to also rotate in the same first, for example clockwise, direction. Alternatively, the drive gear 50 can be coupled to the driven gear 56 in a way that the rotate or move in opposite directions. The spring force of the timer spring 74 can work against the consistent dampening or resistance to rotation of the driven gear 56 of the rotary damper 54 to deliver a known rate at which the drive gear 50 rotates the driven gear 56 to thereby operate as a mechanical timer as detailed herein.

The fastener driving tool 22 can be operated in either a bump mode, or a sequential mode. A user can select the mode of operation by positioning a mode selector 66 mounted outside the housing 26 in either a bump mode position (e.g., FIG. 10) or in a sequential mode position (e.g., FIG. 11). The mode selector 66 can include a pin or protrusion 65 adjacent its distal end relative to pivot pin 68 that is selectively retained in the bump and sequential mode positions by engagement with respective bump and sequential mode detents, recesses, or apertures (not shown) in the housing 26.

Figure 4:
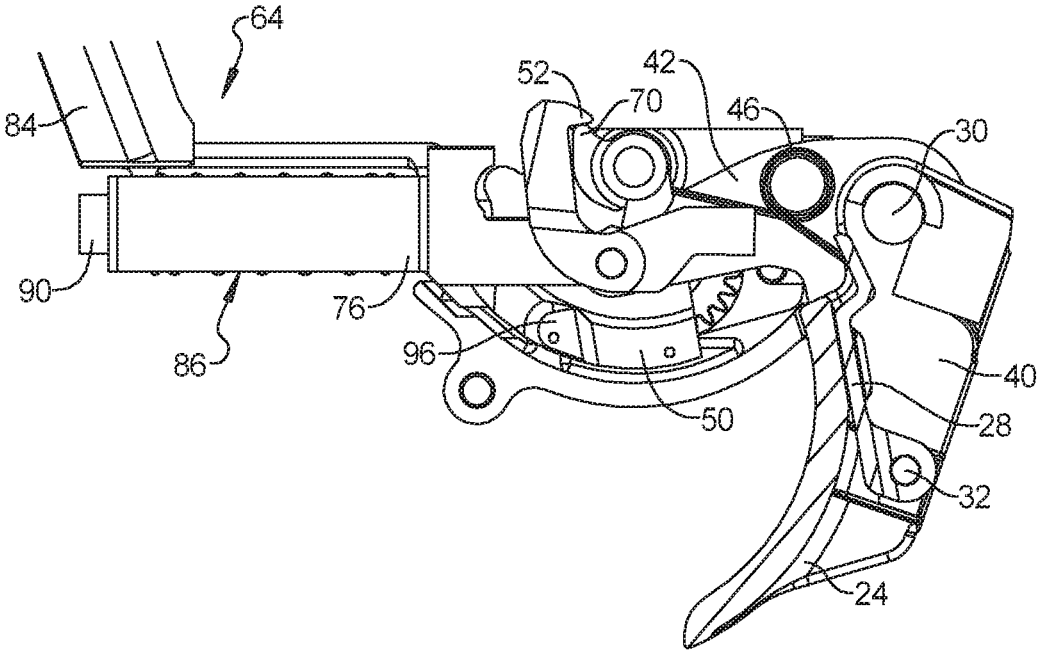
FIG. 4 is a side elevation view of various components of the fastener driving tool trigger assembly of FIG. 1 in their corresponding home and timed-out positions.
Figure 5:
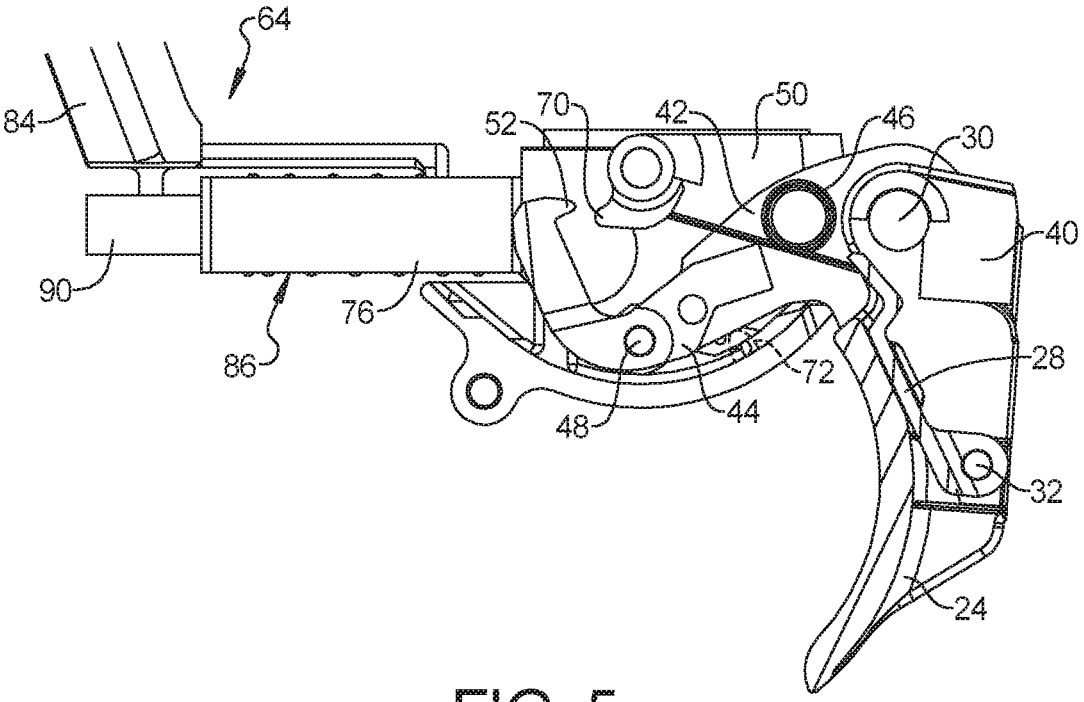
FIG. 5 is a side elevation view similar to FIG. 4 with the various components of the fastener driving tool trigger assembly of FIG. 1 in their corresponding firing and wind-up positions.
Figure 6:
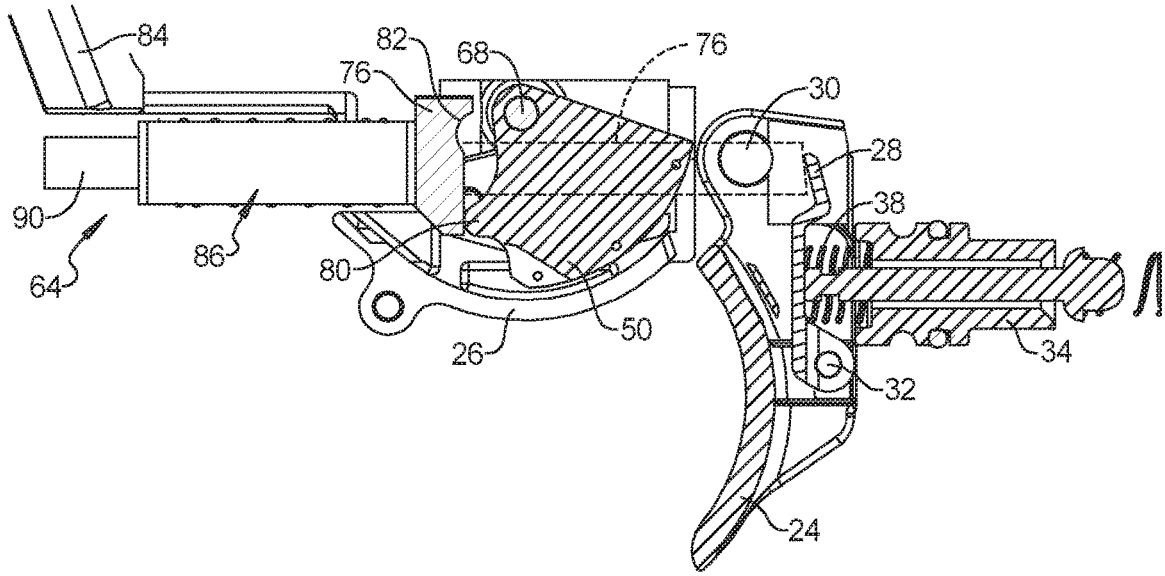
FIG. 6 is a cross-sectional view of various components of the fastener driving tool trigger assembly of FIG. 1 in their corresponding firing and wind-up positions.
Figure 7:
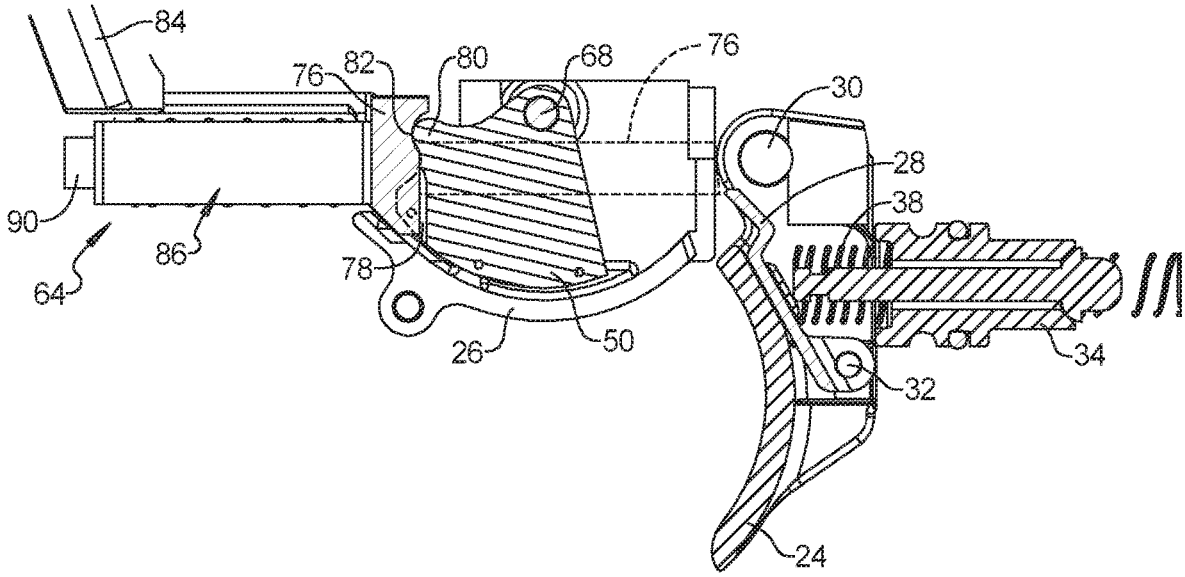
FIG. 7 is a cross-sectional view of various components of the fastener driving tool trigger assembly of FIG. 1 in their corresponding home and timed-out positions.
Figure 8:
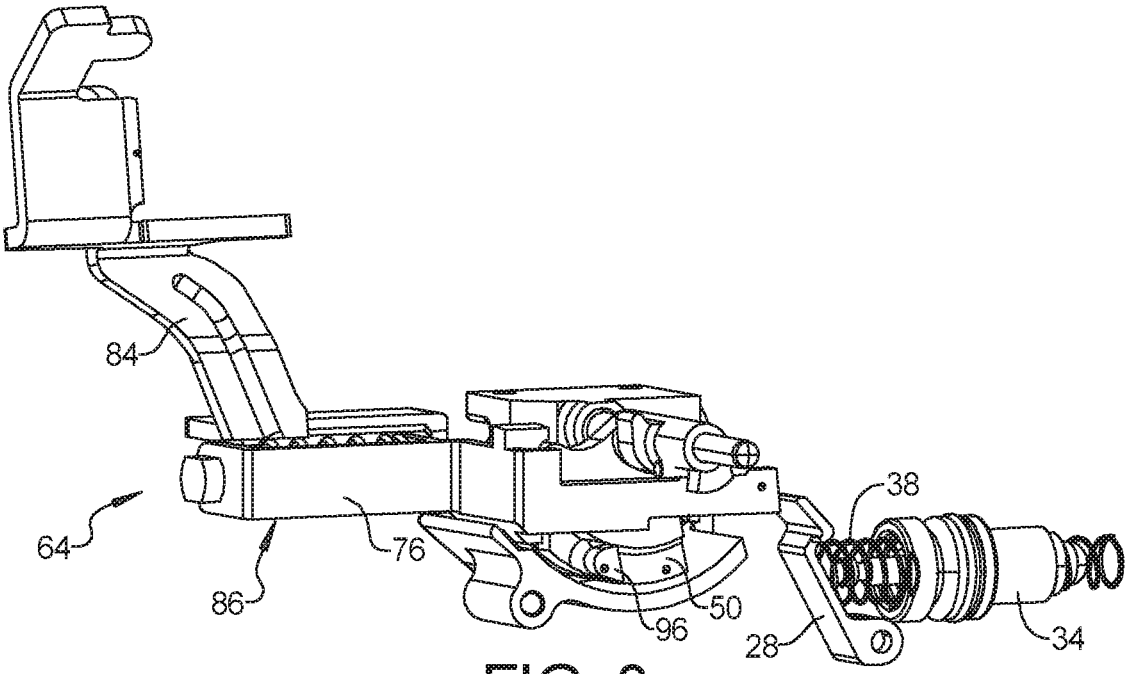
FIG. 8 is a perspective view of various components of the fastener driving tool trigger assembly of FIG. 1.
Figure 9:
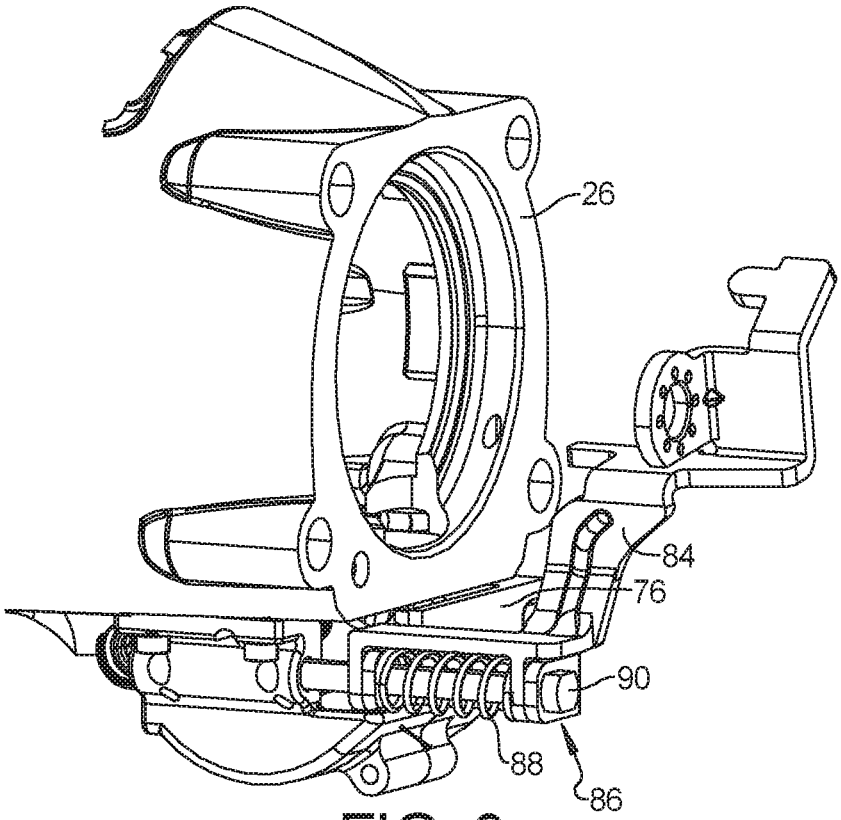
FIG. 9 is another perspective view of various components of the fastener driving tool trigger assembly of FIG. 1.
Figure 10:
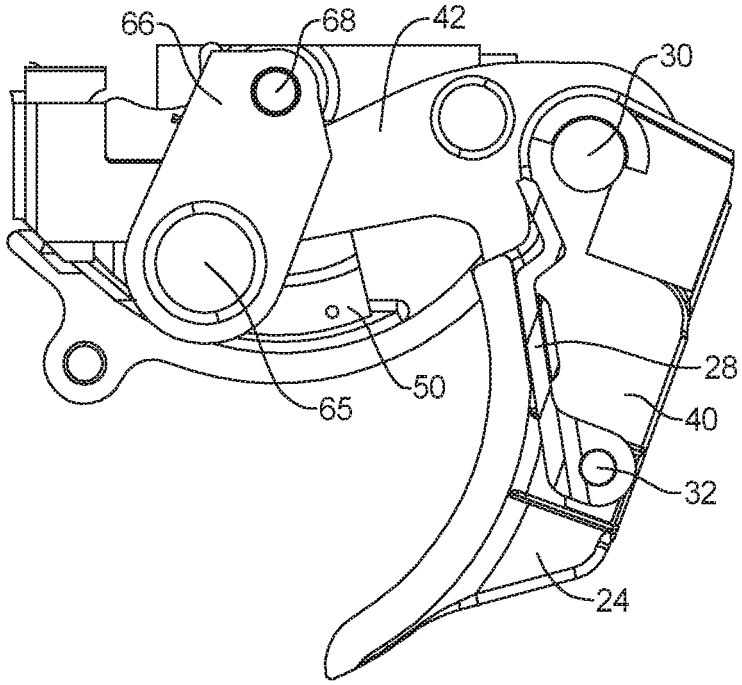
FIG. 10 is a side elevation view of various components of the fastener driving tool trigger assembly of FIG. 1, including a mode selector in a bump mode position.

Operation of the fastener driving tool 22 in bump mode is described with particular reference to FIGS. 4-10. In bump mode, the trigger 24 can first be pulled and rotated counterclockwise toward the trigger valve 34. As seen in FIGS. 4 and 5, this counterclockwise movement of the trigger 24 carries the wind-up arm 44 downward. The wind-up arm 44 can include a hook 52 that is initially hooked on a cooperating wind-up protrusion 70 of the drive gear 50. As the wind-up arm 44 is carried downward by the trigger 24, the hook 52 can pull and rotate the drive gear 50, for example counterclockwise, from its home or timed-out position (FIG. 4) to a wind-up position (FIG. 5). A wind-up arm release protrusion 72 can be provided in the interior of that tool housing 26 to rotate the wind-up arm 44 and cause the hook 52 to release the wind-up protrusion 70 of the drive gear 50 as illustrated in FIG. 5. Upon release of the drive gear 50, the return rotation of the drive gear 50 back toward its timed-out or home position under the influence of the timer spring 74 against the resistance of the rotary damper 54.

During this period, the actuator 28 is initially still in its home position relative to the trigger 24. As the contact trip 64 is pressed against a workpiece, the contact trip 64 moves away from a nose end 36*n* and toward a rear end 36*r* of the driver axis 36 through the tool housing 26. During this rearward movement of the contact trip 64 from its home position into its firing position, the rear arm 76 of the contact trip 64 engages the actuator 28, causing the actuator 28 to be rotated relative to the trigger 24, for example clockwise about pivot pin 32, from this home position (e.g., FIG. 7) to a firing position (e.g., FIG. 6) in which it engages and actuates the trigger valve 34, thereby firing the tool 22 to drive the driver and fastener along the driver axis 36. In other words, firing of the tool 22 requires both rotation of the trigger 24, for example counterclockwise, from its home position toward the trigger valve 34 and rotation of the actuator 28, for example clockwise, relative to the trigger 24 from its home position toward the trigger valve 34. In other words, both the trigger 24 and the actuator 28 must be in their firing positions before the trigger valve 34 is actuated.

During this rearward movement of the contact trip 64 from its home position into its firing position, cooperating engagement surfaces 78 of the rear arm 76 of the contact trip 64 and the drive gear 50 engage each other. As long as the trigger 24 remains in its firing position and the drive gear 50 has not "timed-out" by reaching its home position, each time the contact trip 64 is pressed against a workpiece, the rear arm 76 of the contact trip 64 engages and rotates the drive gear 50 back into its wind-up position to re-start the mechanical timer mechanism. Thus, the contact trip 64 can then be placed into repeated consecutive contact with the workpiece or "bumped" to both rotate the actuator 28 into its firing position, and re-wind the drive gear 50 into is wind-up position to re-start the mechanical timer.

If too much time has passed since the prior "bump" firing, however, so that the drive gear 50 has previously rotated back into its timed-out position (e.g., FIG. 7), the drive gear 50 is oriented so that the engagement between the rear arm 76 of the contact trip 64 is unable to re-wind the drive gear 50, and rearward movement of the rear arm 76 of the contact trip 64 toward its firing position is halted. For example, the cooperating engagement surfaces 78 of the contact trip 64 and drive gear 50 in its timed-out position can be oriented perpendicular to the axial direction of movement of the contact trip 64. As a result, the tool 22 will not fire again until the trigger 24 is allowed to return to its home position and is then re-rotated into its firing position, resulting in the drive gear 50 again being rotated by the wind-up arm 44 from its home or timed-out position (e.g., FIG. 7) to its wind-up position (e.g., FIG. 5) to initiate another "bump" fastener driving cycle.

The cooperating engagement surfaces 78 of the contact trip 64 and drive gear 50 can also be shaped to prevent the tool 22 from firing if the contact trip 64 is engaged against the workpiece prior to pulling the trigger 24, while the tool is in bump mode. For example, the cooperating engagement surfaces 78 can include a protrusion 80 and a recess 82 that lock together when the rear arm 76 of the contact trip 64 is pressed against the drive gear 50 in its timed-out position to prevent rotation of the drive gear 50, which in turn prevents actuation of the trigger 24.

The contact trip 64 can include a front arm 84 coupled to the rear arm 76. As the front arm 84 engages the workpiece and begins moving rearward along the driver axis 36, the movement of the front arm 84 can be transmitted to corresponding movement of the rear arm 76 via a coupling 86. For example, the coupling 86 can include a coupling spring 88 mounted on a rod 90 between the front arm 84 and rear arm 76. If the biasing force of the coupling spring 88 is overcome, however, the front arm 84 can continue to move rearwardly while the rear arm 76 is stopped. For example, when the rear arm 76 is prevented from moving rearward due to the drive gear 50 being in its home or timed-out position, the coupling 86 limits the force transmitted to the drive gear 50, which can protect the drive gear 50 and other components from the tool 22 being bumped or otherwise engaged with significant force against the workpiece.

Figure 11:
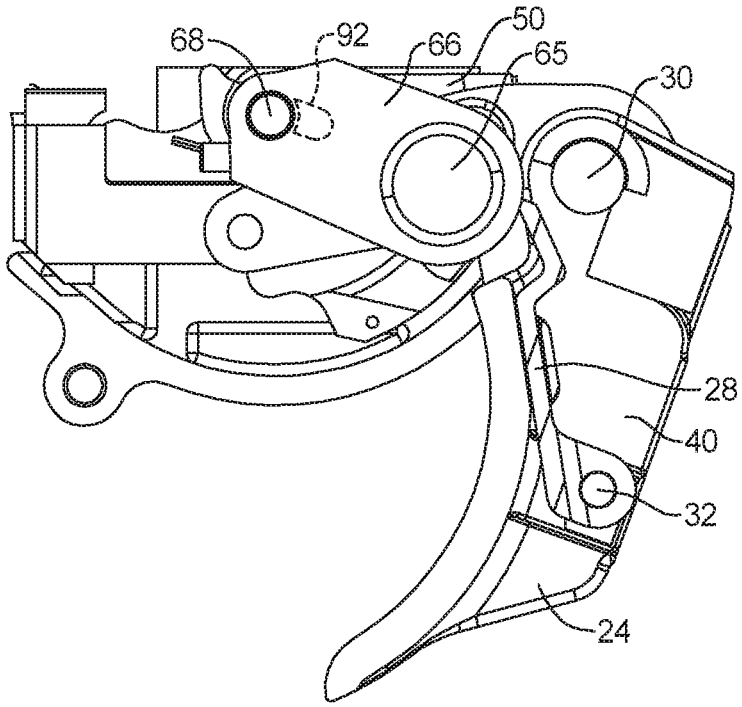
FIG. 11 is a side elevation view of various components of the fastener driving tool trigger assembly of FIG. 1, including a mode selector in a sequential mode position.

Operation of the fastener driving tool 22 in sequential mode is described with particular reference to FIGS. 11-14. To operate the tool in sequential mode, the mode selector 66 is placed into its corresponding sequential mode position (FIG. 11). The mode selector 66 can include a selector protrusion 92 that engages a cooperating selector protrusion 94 of the drive gear 50 to rotate the drive gear 50 into a timer lock-out position (e.g., FIGS. 12 and 13). The drive gear 50 remains in the timer lock-out position as long as the mode selector 66 is in the sequential mode position. Thus, the mechanical timer of the trigger assembly 20 is locked-out or inoperative while the tool 22 is in sequential mode of operation. The timer lock-out position of the drive gear 50 can be a rotary position, for example counterclockwise, past its wind-up position from its home position. In other words, the drive gear 50 can rotate from its home or timed-out position, past its wind-up position, before reaching or moving into its lock-out position.

Figure 12:
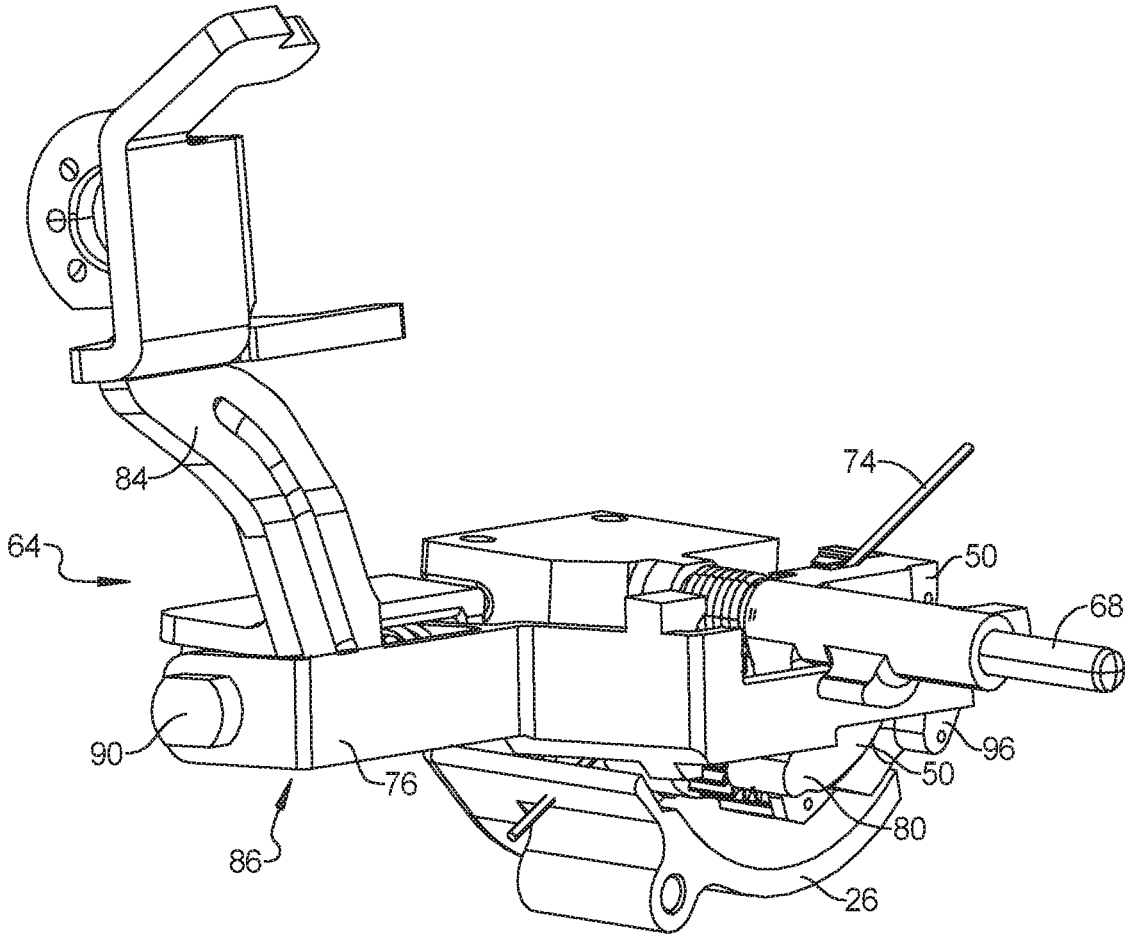
FIG. 12 is a perspective view of various components of the fastener driving tool trigger assembly of FIG. 1, including the rear arm of the contact trip in its by-pass position.
Figure 13:
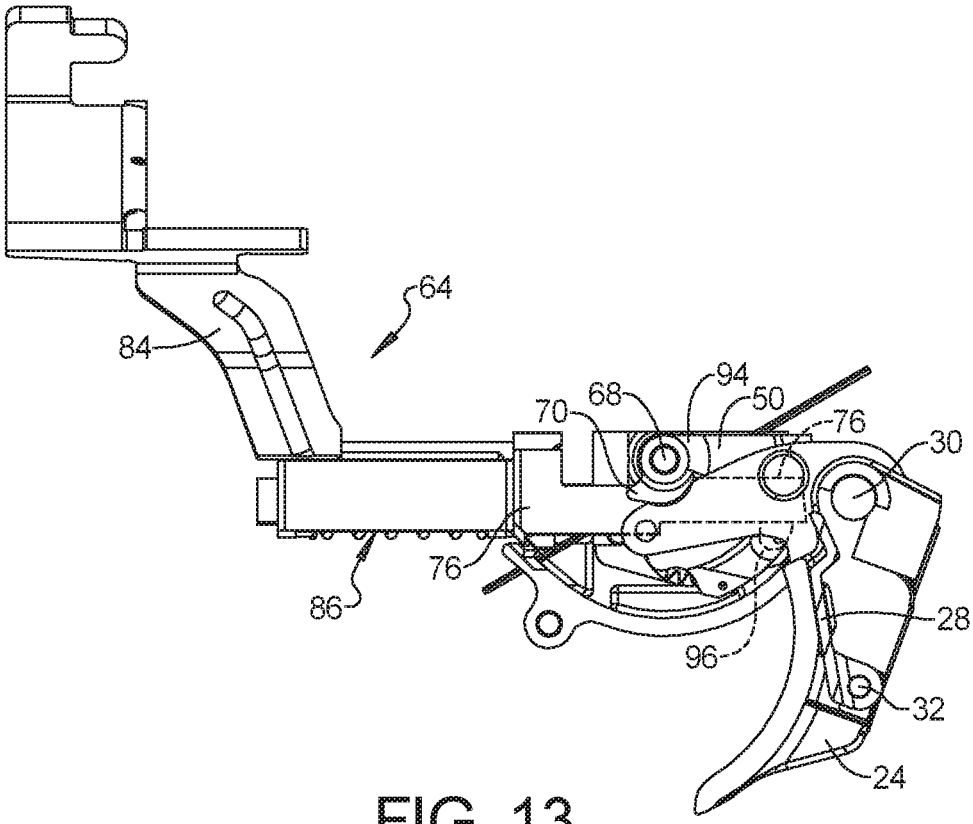
FIG. 13 is a side elevation view of various components of the fastener driving tool trigger assembly of FIG. 1, including the rear arm of the contact trip in its by-pass position with the trigger in its home position.
Figure 14:
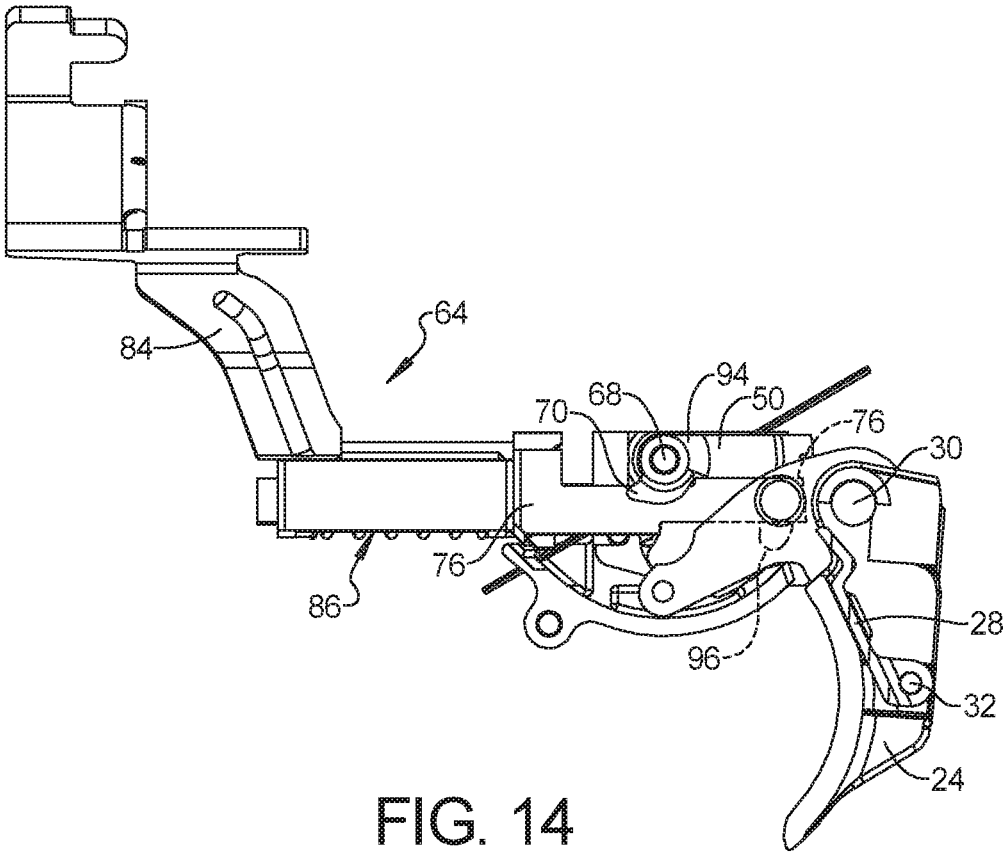
FIG. 14 is a side elevation view of various components of the fastener driving tool trigger assembly of FIG. 1, including the rear arm of the contact trip in its by-pass position with the trigger in its firing position.

The drive gear 50 can include a lifter protrusion 96 which lifts the rear arm 76 of the contact trip, causing the rear arm 76 to rotate about the coupling rod 90 of the contact trip coupling 86 into a trip bypass position (e.g., FIGS. 12-14). In contrast, the front arm 84 can be keyed to the coupling rod 90, so that the front arm 84 cannot rotate to keep the front arm 84 of the contact trip 64 properly aligned with the driver axis 36.

In the trip bypass position, if the contact trip 64 is first moved rearward by engagement with the workpiece prior to the trigger 24 being pulled (e.g., FIG. 13), that the rear arm 76 of the contact trip 64 in its trip bypass position is able to engage the actuator 28 and move the actuator 28 from its home to its firing position which, in combination with the trigger 24 being in its firing position, causes the tool 22 to fire the driver along the driver path 36 and drive a fastener into the workpiece. On the other hand, when the trigger 24 is first moved into its firing position prior to the contact trip 64 being moved rearward by engagement with the workpiece (e.g., FIG. 14), the rotation of the trigger 24 operates to lower the top of the actuator 28 relative to the rear arm 76 of the contact trip 64 enough that the contact trip 64 can pass over or above the top of the actuator 28. Thus, the trigger assembly 20 can ensure that the tool will not fire in the sequential mode of operation unless the contact trip 64 is depressed before the trigger 24 is moved into its firing position when the tool 22 is in the sequential mode of operation.

While aspects of the present invention are described herein and illustrated in the accompanying drawings in the context of a pneumatic fastening tool, those of ordinary skill in the art will appreciate that the invention, in its broadest aspects, has further applicability. As but one example, the second arm 42 of the trigger can extend upwardly from the trigger pivot pin 30. The wind-up arm 44 can extend from a distal end (relative to the trigger pivot pin 30) to engage the drive gear 50 and move the drive gear 50 from its timed-out position to its wind-up position using a pushing action. As another example, the driven gear 56, the drive gear 50, or both, can take the form of linearly arranged teeth, instead of the radially arranged teeth illustrated in the drawing figures.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

What is claimed is:

1. A fastener driving tool trigger assembly comprising:

a rotary damper coupled to a tool housing, the rotary damper having a damper shaft;

a driven gear coupled to the damper shaft to transfer rotation of the driven gear to the damper shaft in a first direction;

a drive gear coupled to the tool housing and being movable between a timed-out position and a wind-up position and biased toward the timed-out position; the drive gear being operably coupled to the driven gear to rotate the driven gear in the first direction as the drive gear moves away from the wind-up position toward the timed-out position and to rotate the driven gear in a second direction opposite the first direction as the drive gear moves away from the timed-out position toward the wind-up position;

a trigger pivotably coupled to the tool housing and movable between a trigger home position and a trigger firing position;

an actuator pivotably coupled to the trigger and movable between an actuator home position and an actuator firing position;

a wind-up arm coupled to the trigger and engageable with the drive gear to move the drive gear away from the timed-out position to the wind-up position in response to the trigger moving away from the trigger home position to the trigger firing position;

a contact trip coupled to the tool housing and movable between a trip home position and a trip firing position and, with the drive gear positioned between the timed-out position and the wind-up position, the contact trip being engageable with the drive gear to move the drive gear into the wind-up position as the contact trip moves from the trip home position to the trip firing position and, with the trigger positioned in the trigger firing position, the contact trip being engageable with the actuator to move the actuator into the actuator firing position as the contact trip moves from the trip home position to the trip firing position and, with the drive gear positioned in the timed-out position, the contact trip being engageable with the drive gear, with the drive gear in an orientation which prevents the contact trip from rotating the drive gear into the wind-up position and prevents the contact trip from moving into the trip firing position.

2. The fastener driving tool trigger assembly of claim 1, further comprising a one-way clutch coupled to the damper shaft between the damper shaft and the driven gear to transfer rotation of the driven gear to the damper shaft in the first direction, but not in the second direction.

3. The fastener driving tool trigger assembly of claim 2, wherein the driven gear is mounted on the damper shaft with the one-way clutch mounted on the damper shaft between the driven gear and the damper shaft.

4. The fastener driving tool trigger assembly of claim 1, wherein the contact trip has a front arm and a rear arm moveably coupled together at a coupling including a biasing member, the front arm of the contact trip being selectively engageable with a workpiece, and the rear arm of the contact trip being selectively engageable with the drive gear, and wherein the biasing member allowing the front arm to continue moving away from the trigger home position while movement of the rear arm away from the trigger home position is arrested by engagement of the drive gear with the drive gear positioned in the timed-out position in an orientation which prevents the rear arm from rotating the drive gear into the wind-up position and prevents the rear arm from moving into the trip firing position.

5. The fastener driving tool trigger assembly of claim 1, wherein the wind-up arm includes a hook that engages a wind-up protrusion of the drive gear to move the drive gear from the timed-out position to the wind-up position in response to the trigger moving from the trigger home position to the trigger firing position.

6. The fastener driving tool trigger assembly of claim 5, wherein the wind-up arm is pivotably coupled to the trigger and, with the trigger in the trigger firing position, engagement of the wind-up arm with the tool housing rotates the wind-up arm to move the hook away from the wind-up protrusion of the drive gear and release the drive gear.

7. The fastener driving tool trigger assembly of claim 6, wherein the tool housing includes an internal protrusion that rotates the wind-up arm to move the hook away from the wind-up protrusion of the drive gear and release the drive gear.

8. The fastener driving tool trigger assembly of claim 1, wherein, with the drive gear positioned in the timed-out position, cooperating engagement surfaces of the drive gear and the contact trip are oriented normal to a direction of movement of the contact trip between the trip home position and the trip firing position.

9. The fastener driving tool trigger assembly of claim 1, wherein cooperating engagement surfaces of the drive gear and the contact trip include a protrusion and a recess, and with the drive gear positioned in the timed-out position and the cooperating engagement surfaces of the drive gear and the contact trip cooperatively engage, the protrusion is received in the recess to limit movement of the trigger from the trigger home position to the trigger firing position.

10. A fastener driving tool trigger assembly comprising:

a rotary damper coupled to a tool housing, the rotary damper having a damper shaft;

a driven gear coupled to the damper shaft to transfer rotation of the driven gear to the damper shaft in a first direction;

a drive gear coupled to the tool housing and movable between a timed-out position and a wind-up position and being biased toward the timed-out position; the drive gear being operably coupled to the driven gear to rotate the driven gear in the first direction as the drive gear moves away from the wind-up position toward the timed-out position and to rotate the driven gear in a second direction opposite the first direction as the drive gear moves away from the timed-out position toward the wind-up position;

a trigger pivotably coupled to the tool housing and movable between a trigger home position and a trigger firing position;

an actuator pivotably coupled to the trigger and movable between an actuator home position and an actuator firing position;

a mode selector coupled to the tool housing and movable between a bump mode position and a sequential mode position and, with the mode selector in the sequential mode position, the mode selector being operably coupled to the drive gear to hold the drive gear in a timer lock-out position;

a wind-up arm coupled to the trigger and, with the mode selector in the bump mode position, the wind-up arm being engageable with the drive gear to move the drive gear from the timed-out position to the wind-up position in response to the trigger moving from the trigger home position to the trigger firing position;

a contact trip coupled to the tool housing and movable between a trip home position and a trip firing position and, with the mode selector in the bump mode position and the drive gear positioned between the timed-out position and the wind-up position, the contact trip being engageable with the drive gear to move the drive gear into the wind-up position as the contact trip moves from the trip home position to the trip firing position and, with the mode selector in the bump mode position and the trigger positioned in the trigger firing position, the contact trip being engageable with the actuator to move the actuator into the actuator firing position as the contact trip moves from the trip home position to the trip firing position, and with the mode selector in the bump mode position and the drive gear positioned in the timed-out position, the contact trip being engageable with the drive gear with the drive gear in an orientation which prevents the contact trip from rotating the drive gear into the wind-up position and prevents the contact trip from moving into the trip firing position.

11. The fastener driving tool trigger assembly of claim 10, further comprising a one-way clutch coupled to the damper shaft between the damper shaft and the driven gear to transfer rotation of the driven gear to the damper shaft in the first direction, but not in the second direction.

12. The fastener driving tool trigger assembly of claim 11, wherein the driven gear is mounted on the damper shaft with the one-way clutch mounted on the damper shaft between the driven gear and the damper shaft.

13. The fastener driving tool trigger assembly of claim 10, wherein the timer lock-out position of the drive gear is past the wind-up position from the timed-out position of the drive gear.

14. The fastener driving tool trigger assembly of claim 10, wherein the contact trip has a front arm and a rear arm moveably coupled together at a coupling, the rear arm of the contact trip being selectively rotatable relative to the front arm at the coupling and, with the mode selector in the sequential mode position, the drive gear engages the rear arm to rotate the contact trip relative to the front arm and into a by-pass position and, with the rear arm in the by-pass position and the trigger in the trigger home position, the rear arm is engageable with the actuator to move the actuator into the actuator firing position as the contact trip moves into the trip firing position, but with the rear arm in the by-pass position and the trigger in the trigger firing position, the rear arm by-passes the actuator without moving the actuator into the actuator firing position as the contact trip moves into the trip firing position.

15. The fastener driving tool trigger assembly of claim 14, wherein the drive gear includes a protrusion that engages the rear arm of the contact trip to lift the contact trip and rotate the rear arm into the by-pass position.

16. The fastener driving tool trigger assembly of claim 14, wherein the coupling including a biasing member, and wherein, with the mode selector in the bump mode position, the biasing member allowing the front arm to continue moving away from the trigger home position while movement of the rear arm away from the trigger home position is arrested by engagement of the drive gear with the drive gear positioned in the timed-out position in an orientation which prevents the rear arm from rotating the drive gear into the wind-up position and prevents the rear arm from moving into the trip firing position.

17. The fastener driving tool trigger assembly of claim 10, wherein the wind-up arm includes a hook that is engageable with a wind-up protrusion of the drive gear, with the mode selector in the bump mode position, to move the drive gear from the timed-out position to the wind-up position in response to the trigger moving from the trigger home position to the trigger firing position.

18. The fastener driving tool trigger assembly of claim 17, wherein the wind-up arm is pivotably coupled to the trigger and, with the trigger in the trigger firing position and the mode selector in the bump mode position, engagement of the wind-up arm with the tool housing rotates the wind-up arm to move the hook away from the wind-up protrusion of the drive gear and release the drive gear.

19. The fastener driving tool trigger assembly of claim 18, wherein the tool housing includes an internal protrusion that rotates the wind-up arm to move the hook away from the wind-up protrusion of the drive gear and release the drive gear.

20. The fastener driving tool trigger assembly of claim 10, wherein, with the drive gear positioned in the timed-out position and the mode selector in the bump mode position, cooperating engagement surfaces of the drive gear and the contact trip are oriented normal to a direction of movement of the contact trip between the trip home position and the trip firing position.

21. The fastener driving tool trigger assembly of claim 10, wherein cooperating engagement surfaces of the drive gear and the contact trip include a protrusion and a recess, and with the mode selector in the bump mode position and the drive gear positioned in the timed-out position and the cooperating engagement surfaces of the contact trip and the drive gear cooperatively engaged, the protrusion is received in the recess to limit movement of the trigger from the trigger home position to the trigger firing position.

* * * * *